US012128287B1

(12) United States Patent
Mohl

(10) Patent No.: US 12,128,287 B1
(45) Date of Patent: Oct. 29, 2024

(54) CORNHOLE LEVEL

(71) Applicant: Robert Anthony Mohl, Harrisburg, PA (US)

(72) Inventor: Robert Anthony Mohl, Harrisburg, PA (US)

( * ) Notice: Subject to any disclaimer, the term of this patent is extended or adjusted under 35 U.S.C. 154(b) by 0 days.

(21) Appl. No.: 18/679,020

(22) Filed: May 30, 2024

Related U.S. Application Data

(60) Provisional application No. 63/509,007, filed on Jun. 19, 2023.

(51) Int. Cl.
*A63B 71/02* (2006.01)
*A63B 67/06* (2006.01)

(52) U.S. Cl.
CPC ..... *A63B 71/023* (2013.01); *A63B 67/06* (2013.01)

(58) Field of Classification Search
CPC ..... A63B 71/023; A63B 67/06
USPC ..... 273/407, 408
See application file for complete search history.

(56) References Cited

U.S. PATENT DOCUMENTS 4,463,684 A * 8/1984 Klungle ..... A47B 57/10 D6/675.1
D332,647 S * 1/1993 Johnson ..... D25/65
6,948,688 B1 * 9/2005 Payne ..... A47C 19/024 5/509.1
6,968,583 B1 * 11/2005 Rich ..... A47C 19/045 5/509.1
9,033,293 B1 * 5/2015 Glenn ..... A47B 91/005 248/346.11
D929,212 S * 8/2021 Guindi ..... D8/374
11,173,363 B1 * 11/2021 Pontrelli ..... A63B 67/06
11,253,068 B2 * 2/2022 Geyer ..... A47B 91/12
11,439,880 B1 * 9/2022 Pontrelli ..... A63B 71/023
12,036,459 B1 * 7/2024 Force ..... A63B 67/06
2007/0080499 A1 * 4/2007 Greiwe ..... A63B 67/06 273/400
2008/0048397 A1 * 2/2008 Mancini ..... A63B 67/06 273/343
2017/0340937 A1 * 11/2017 Poetter ..... A63B 67/06
2018/0043227 A1 * 2/2018 Segerstrom ..... A63B 67/06
2020/0146448 A1 * 5/2020 Wendling ..... A47B 91/12
2020/0406114 A1 * 12/2020 Spady ..... A63B 63/08
2021/0146210 A1 * 5/2021 Roberts, Jr. ..... A63B 67/06
2023/0133961 A1 * 5/2023 Carroll ..... A63B 47/00 273/398
2024/0075365 A1 * 3/2024 Rockett ..... A63B 71/023
2024/0091614 A1 * 3/2024 Rodgers, Sr. ..... A63B 69/00

* cited by examiner

*Primary Examiner* — Muhammad Ijaz

(57) ABSTRACT

A cornhole leveler is used to ensure that cornhole played on an uneven surface while maintain the cornhole board to be level. The cornhole leveler is formed with 4 walls which creates a hollow support column. The hollow column allows for the cornhole legs to be inserted into the hollow column. The support column has a support rail on opposite sides from another. Each support rail has a plurality of apertures across them allowing for pins to be inserted through the apertures to keep the cornhole leveler in place on the grass. A shelf is removably inserted through an aperture on the rear wall of the support column.

15 Claims, 9 Drawing Sheets

CORNHOLE LEVEL

FIELD OF THE INVENTION

The present invention relates generally to sporting event apparatuses. More specifically, the present invention is a cornhole board leveler.

BACKGROUND OF THE INVENTION

Cornhole is a common indoor and outdoor sporting event that is played at backyard BBQ's, picknicks and can even be played on a competitive level at competitions. Cornhole boards are designed by having a slanted main game board face that is positioned at a ten degree angle to the ground it rests on. The cornhole board is kept in a slanted angle to the ground by a set of legs on the rear board directly on the ground. The front of the boards rest directly on the ground, with the frame of the board resting in direct contact with the ground. One needs to ensure the cornhole board is kept level given that cloth bean bags are tossed at the cornhole board and can slide against the smooth board surface if the board is not kept level.

Cornhole often played outdoors and does not always have a more level surface to be placed upon. Further even when placed on what would be presumed to be a level surface, such as one's driveway or cement parking lots, the game boards still are not always level. An object of the present invention is to give the cornhole board a flat surface to place the legs in giving rise to the gameboard to level the cornhole board for use.

DETAIL DESCRIPTIONS OF THE INVENTION

Figure 1:
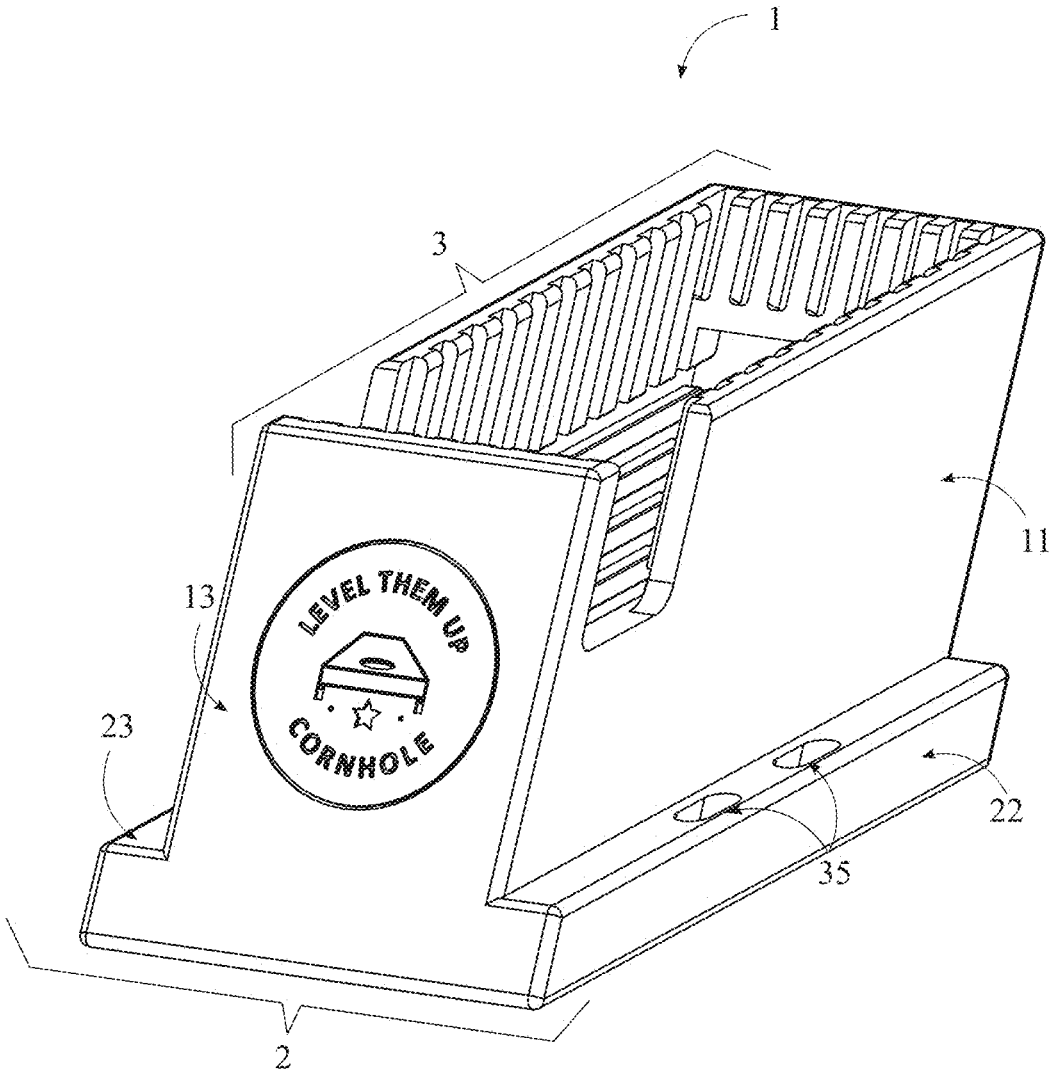
FIG. 1 is an isometric front view of the invention.
Figure 2:
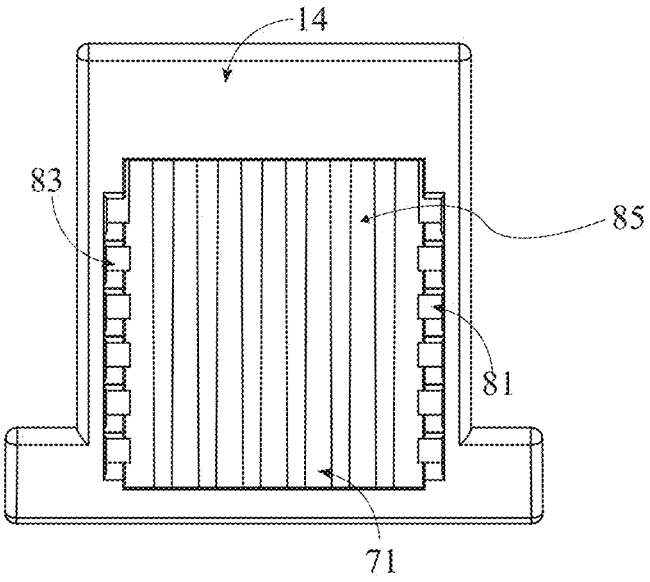
FIG. 2 is a rear view of the present invention.
Figure 3:
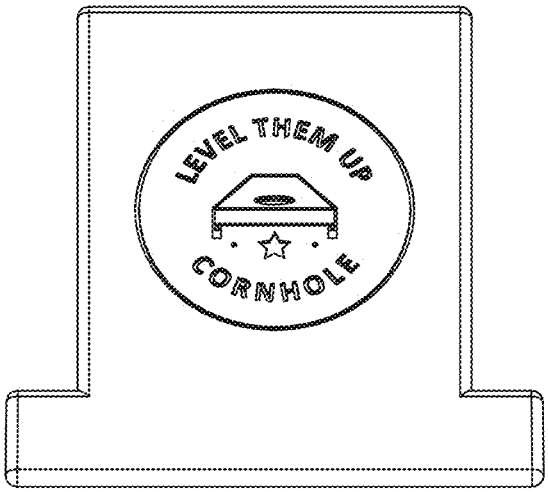
FIG. 3 is a front view of the present invention.
Figure 4:
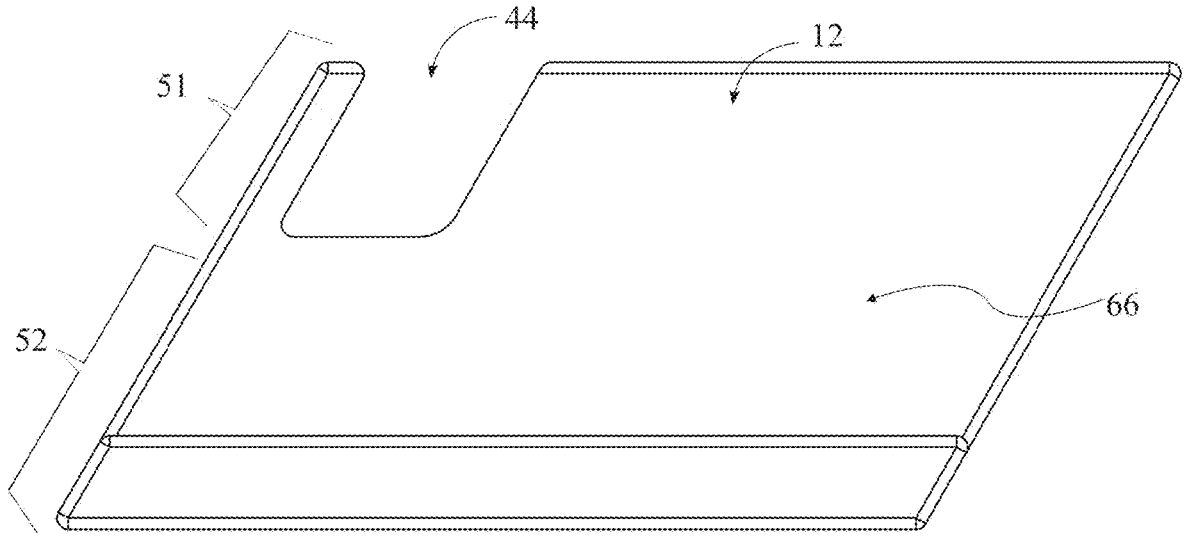
FIG. 4 is a left view of the present invention.
Figure 5:
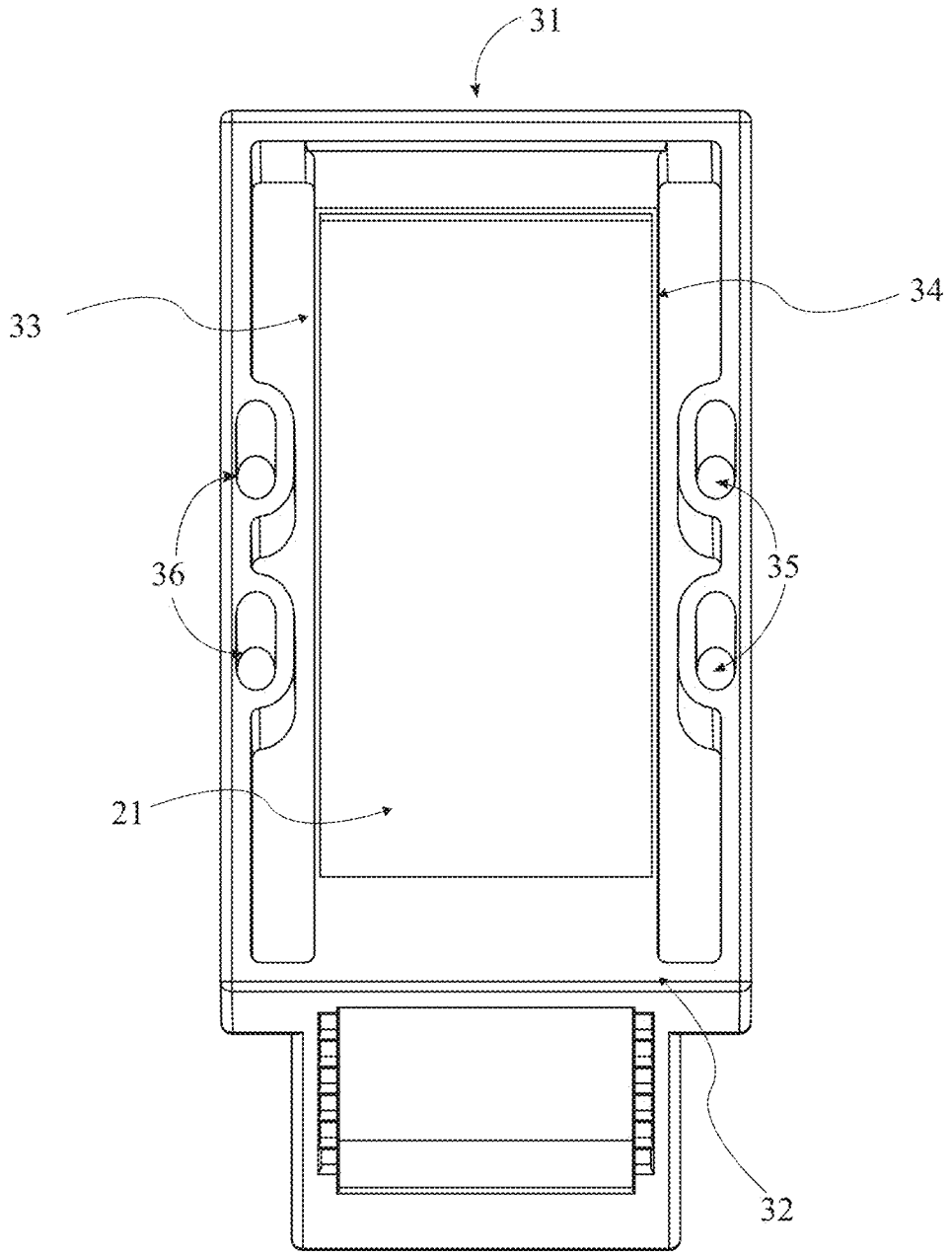
FIG. 5 is a bottom view of the present invention.
Figure 6:
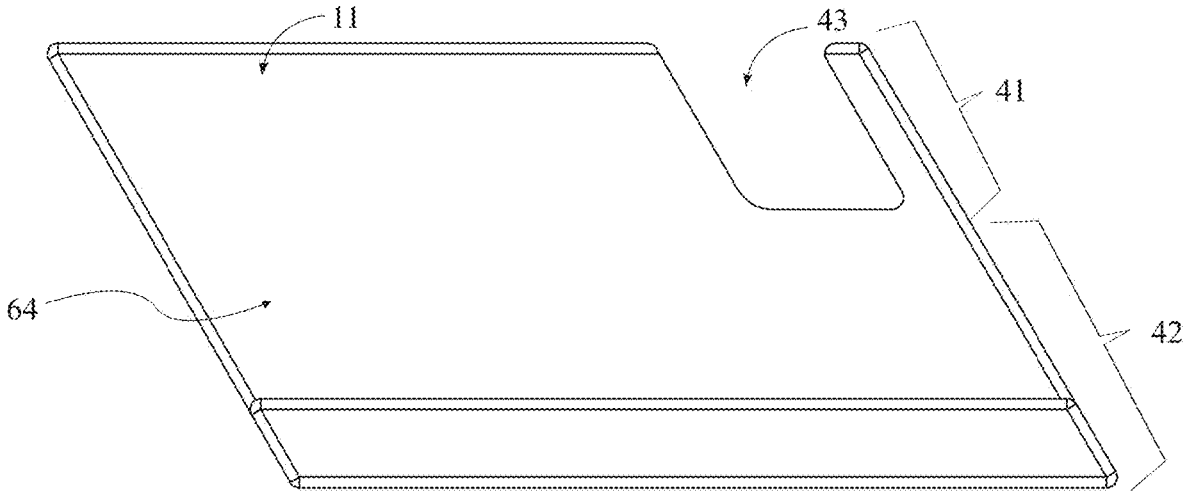
FIG. 6 is a side view of the present invention.
Figure 7:
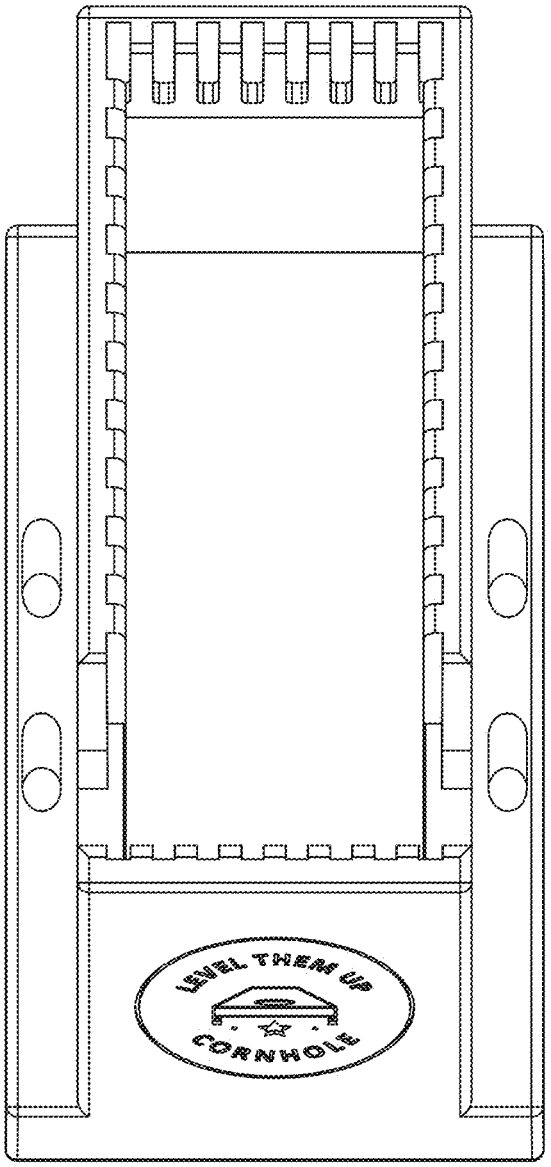
FIG. 7 is a top view of the present invention.
Figure 8:
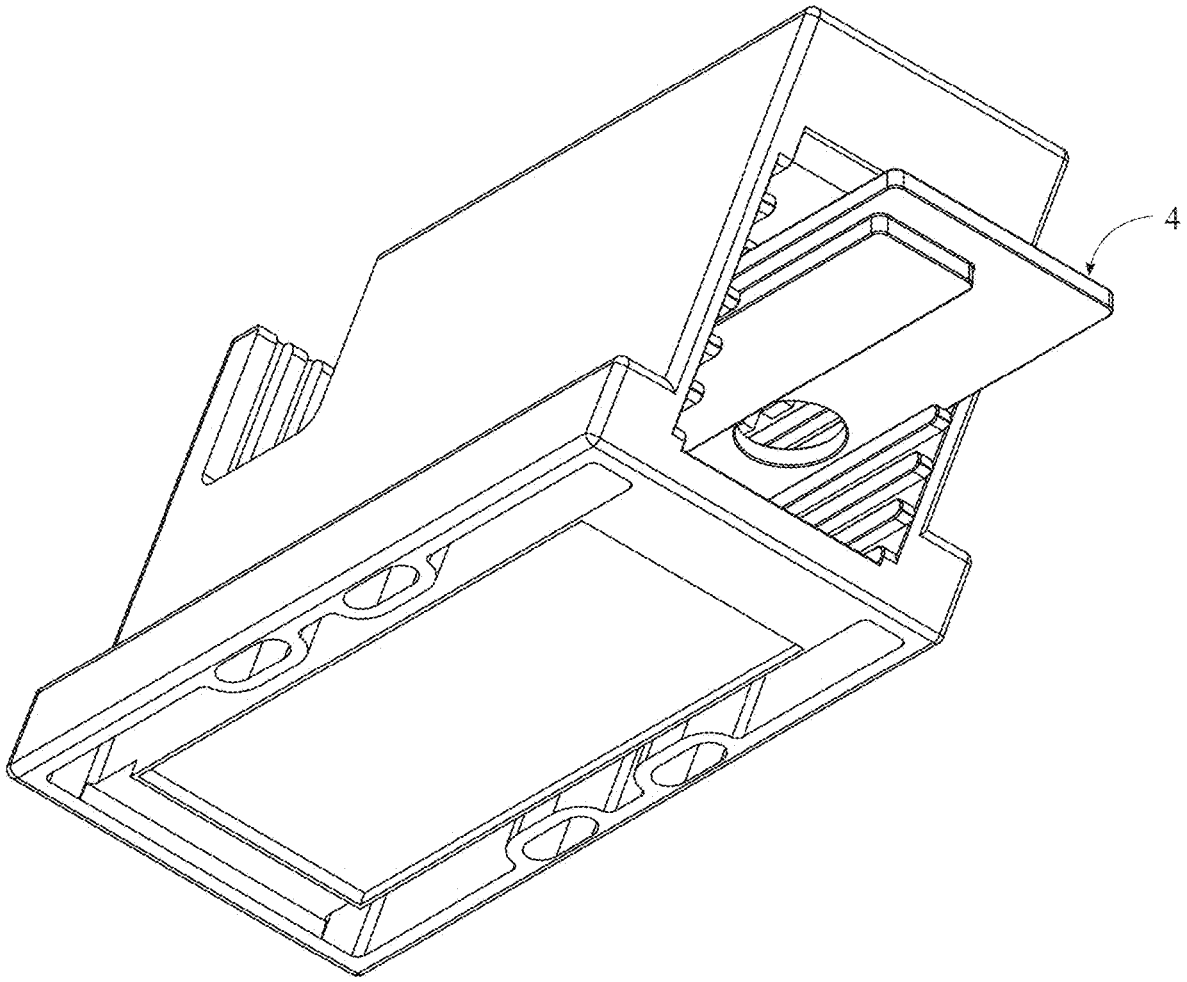
FIG. 8 is an isometric view of the shelf insert of the present invention.
Figure 9:
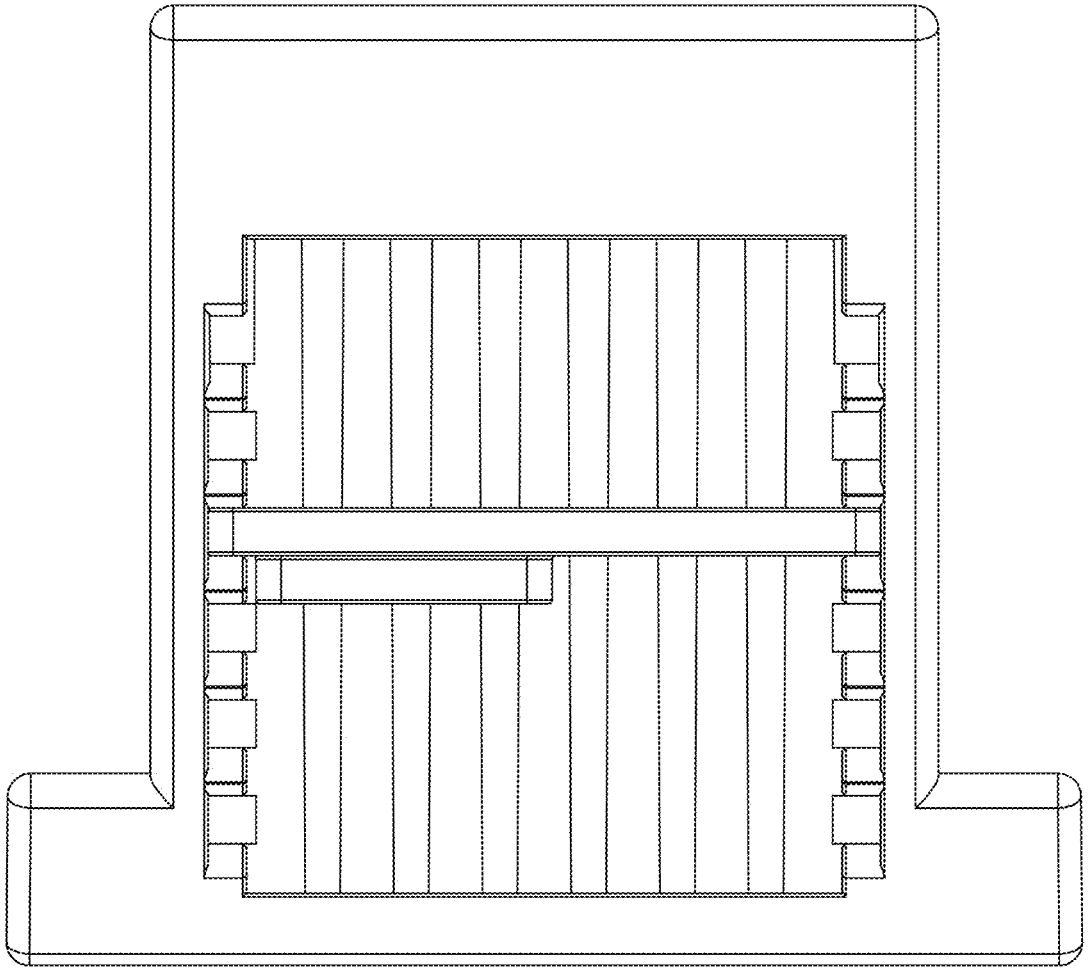
FIG. 9 is a rear view with the shelf inserted of the present invention.

In reference to FIGS. 1-7, the present invention is a device designed to have the cornhole game board leg placed into it, giving the leg a "lift" to bring the board flat and level for use. If a cornhole board game is not positioned level on the ground, it creates a slanted surface that could cause the cornhole bean bags to improperly from the force of one throwing it or could position the hole at an angle that provides an advantage or disadvantage to a player.

The cornhole leveler 1 is multifunctional in that it accommodates multiple size legs of various cornhole boards. All cornhole board legs are already positioned at an angle from the playing surface and therefor this cornhole leveler 1 comes configured at an angle to be able to accept the legs of a board at an angle. The cornhole leveler 1 comprises a base 2 and a support column 3. In any embodiment, the support column 3 remains the same. The support column 3 comprises a front wall 13, a rear wall 14, a left wall 11, and a right wall 12. The support column 3 is formed when the front wall 13, rear wall 14, left wall 11, and right wall 12 are connected to one another. Once all four walls are connected to one another, a hollow rectangular shaped channel is formed. This hollow channel is where the legs of the cornhole board are inserted. The base 2 is comprised of a base panel 21, a left support rail 23, and a right support rail 22. The front wall 13 is fully sealed to the two side panels and base panel 21. The front wall 13, left wall 11, rear wall 14, and right wall 12 are positioned directly on top of the base panel 21. The support column 3 is centrally positioned on top of the base panel 21.

The base panel 21 has a front edge 31 and a rear edge 32. The base panel 21 is the surface that is placed on the ground or the grass. The top side remains open and exposed to air. This creates a pocket within the cornhole leveler 1 that provides the empty space needed to allow a cornhole boards legs to be positioned within the cornhole leveler 1. The support column 3 traverses the length of the base panel 21. The base panel 21 further bears a left edge 33 and a right edge 34. The support column 3 is angularly positioned on the base panel 21. The angular position is needed as standard cornhole boards come with their legs already in an angled position. The front wall 13 has an internal surface 61 as does the rear wall 14 also bears an internal surface 62. Similarly, the left wall 11 has an internal 63 and external surface 64 and the right wall 12 has an internal surface 65 and external surface 66.

The rear wall 14 of the cornhole leveler 1 has a rear aperture 71. This rear aperture 71 is off center as it is positioned on the lower quadrant of the rear wall 14. The left wall 11 is positioned between the front wall 13 and the rear wall 14. The right wall 12 is positioned between the front wall 13 and the rear wall 14 opposite the left wall 11. This forms the rectangular support column 3. The left wall 11 has a divot 43 positioned where the left wall 11 connects to the front wall 13 and the right wall 12 has a divot 44 positioned where the right wall 12 connects to the front wall 13.

The left support rail 23 abuts the left wall 11 of the support cylinder and the right support rail 22 abuts the right edge 34 of the support cylinder. The left support rail 23 and right support rail 22 lie flush with the ground and provides added support to the cornhole leveler 1 when in use. Both the left support rail 23 and right support rail 22 traverse the length of left edge 33 and right edge 34 respectively of the support column 3. The left support rail 23 bears a plurality of left rail apertures 36. The right rail bears a plurality of right rail apertures 35. The right rail apertures 35 and the left rail apertures 36 traverse through the entire thickness of the support rails. These apertures allow for landscape pins to be inserted through the aperture and into the grass to secure the cornhole board in place. Additionally, the underside of the base panel 21 is coated with an antiskid material to prevent the cornhole board from sliding around smooth surfaces.

As can be seen in the figures, a variety of grooves are positioned throughout the cornhole leveler 1. The front wall 13 has a plurality of front vertical grooves 85 spaced across the internal surface while the rear wall 14 has a plurality of rear vertical grooves 86 spaced across the internal surface. The left wall 11 has an upper portion 41 and a lower portion 42 and the right wall 12 also has an upper portion 51 and a lower portion 52. The upper portion 41 of the left wall 11 has a plurality of left vertical grooves 82. The upper portion 51 of the right wall 12 further also has a plurality of right vertical grooves 84.

The lower portion 42 of the left wall 11 comprises a plurality of left horizontal grooves 81 while the lower portion 52 of the right wall 12 comprises a plurality of right horizontal grooves 83. The horizontal grooves are necessary to allow for a shelf 4 to be inserted for different sized cornhole legs. The plurality of left vertical grooves 82 traverse the length of the left wall 11 the plurality of right horizontal grooves 83 traverse the length of the left wall 11. The plurality of right vertical grooves traverse the length of the right wall 12 and the plurality of right horizontal grooves traverse 83 the length of the right wall 12.

Each of the plurality of grooves are spaced an equal distance apart from one another. This space created in between each notch allows for a removeable shelf 4 to be inserted. The shelf 4 can be positioned on a higher groove if the ground the board is sitting on is unlevel.

The removable shelf 4 is a stepped design with single step, though a shelf 4 with a multistep feature can be used. The shelf 4 has a larger panel and a smaller panel. The smaller panel is positioned on one half of the larger shelf 4. This stepped design in which the smaller panel is only on one half of the larger panel is beneficial for narrower cornhole board legs. The single stepped design creates a snug fit around the base of a cornhole gameboard leg that is narrower than the width of the cornhole leveler 1 body itself. The removeable shelf 4 is inserted into the cornhole leveler 1 body and rests on the notches. In another embodiment, the shelf 4 insert can be removed. When the shelf 4 is inserted with the steps facing down, it provides a flat surface and allows for a wider cornhole board game leg to be inserted into the cornhole leveler 1.

Although the invention has been explained in relation to its preferred embodiment, it is to be understood that many other possible modifications and variations can be made without departing from the spirit and scope of the invention.

What is claimed is:

1. A cornhole leveler comprising:
a base;
a support column;
the support column having a front wall, a rear wall a left wall, and a right wall;
the base comprising a base panel, a left support rail, and a right support rail;
the base panel comprising a front edge and a rear edge;
the front wall having an internal surface and an external surface;
the left wall having an internal surface and an external surface;
the rear wall having an internal surface and an external surface;
the right wall having an internal surface and an external surface;
and the rear wall having a rear aperture;
the rear aperture being positioned off center in the rear wall;
the support column further comprising a shelf; and
the shelf being removably inserted through the rear aperture.

2. The cornhole leveler as claimed in claim 1 comprising:
the support column being centrally positioned on top of the base panel;
the support column traversing the length of the base panel; and
the base panel further comprising a left edge and a right edge.

3. The cornhole leveler as claimed in claim 1 comprising:
the support column being angularly positioned on the base panel.

4. The cornhole leveler as claimed in claim 1 comprising:
the left wall being positioned between the front wall and the rear wall;
the right wall being positioned between the front wall and the rear wall opposite the left wall;
the left wall having a divot positioned where the left wall connects to the front wall; and
the right wall having a divot positioned where the right wall connects to the front wall.

5. The cornhole leveler as claimed in claim 1 comprising:
the front wall having a plurality of front vertical grooves spaced across the internal surface; and
the rear wall having a plurality of rear vertical grooves spaced across the internal surface.

6. The cornhole leveler as claimed in claim 1 comprising:
the left wall comprising an upper portion and a lower portion;
the upper portion of the left wall having a plurality of left vertical grooves;
the lower portion of the left wall comprising a plurality of left horizontal grooves;
the plurality of left vertical grooves traversing the length of the left wall; and
the plurality of right horizontal grooves traversing the length of the left wall.

7. The cornhole leveler as claimed in claim 1 comprising:
the right wall comprising an upper portion and a lower portion;
the upper portion of the right wall having a plurality of right vertical grooves;
the lower portion of the right wall comprising a plurality of right horizontal grooves;
the plurality of right vertical grooves traversing the length of the right wall; and
the plurality of right horizontal grooves traversing the length of the right wall.

8. The cornhole leveler as claimed in claim 1:
the left support rail abutting the left edge of the base panel;
the right support rail abutting the right edge of the base panel;
the left support rail traversing the length of the left edge of the base panel;
the right support rail traversing the length of the right edge of the base panel; and
the left support rail having a plurality of apertures.

9. The cornhole leveler as claimed in claim 1 comprising:
the left support rail having a plurality of apertures;
the plurality of left support apertures traverse through the right support rail;
the right support rail having a plurality of apertures; and
the plurality of right support apertures traverse through the right support rail.

10. A cornhole leveler comprising:
a base;
a support column;
the support column having a front wall, a rear wall a left wall, and a right wall;
the base comprising a base panel, a left support rail, and a right support rail; and
the base panel comprising a front edge and a rear edge;
the support column being centrally positioned on top of the base panel;
the support column traversing the length of the base panel;
the base panel further comprising a left edge and a right edge;
the support column being angularly positioned on the base panel;

the front wall having an internal surface and an external surface;

the left wall having an internal surface and an external surface;

the rear wall having an internal surface and an external surface;

the right wall having an internal surface and an external surface;

and the rear wall having a rear aperture;

the rear aperture being positioned off center in the rear wall;

the support column further comprising a shelf; and the shelf being removably inserted through the rear aperture.

11. The cornhole as claimed in claim 10 comprising:

the left wall being positioned between the front wall and the rear wall;

the right wall being positioned between the front wall and the rear wall opposite the left wall;

the left wall having a divot positioned where the left wall connects to the front wall; and the front wall having a plurality of front vertical grooves spaced across the internal surface; and the rear wall having a plurality of rear vertical grooves spaced across the internal surface.

12. The cornhole leveler as claimed in claim 10:

the right wall having a divot positioned where the right wall connects to the front wall;

the left wall comprising an upper portion and a lower portion;

the upper portion of the left wall having a plurality of left vertical grooves;

the lower portion of the left wall comprising a plurality of left horizontal grooves;

the plurality of left vertical grooves traversing the length of the left wall; and the plurality of right horizontal grooves traversing the length of the left wall.

13. The cornhole leveler as claimed in claim 12 comprising:

the right wall comprising an upper portion and a lower portion;

the upper portion of the right wall having a plurality of right vertical grooves;

the lower portion of the right wall comprising a plurality of right horizontal grooves;

the plurality of right vertical grooves traversing the length of the right wall;

the plurality of right horizontal grooves traversing the length of the right wall; and the left support rail abutting the left edge of the base panel.

14. The cornhole leveler as claimed in claim 10 comprising:

the left support rail traversing the length of the left edge of the base panel;

the right support rail traversing the length of the right edge of the base panel; and the left support rail having a plurality of apertures.

15. The cornhole leveler as claimed in claim 12 comprising:

the right support rail abutting the right edge of the base panel;

the left support rail having a plurality of apertures;

the plurality of right support apertures traverse through the right support rail;

the right support rail having a plurality of apertures; and the plurality of right support apertures traverse through the right support rail.

* * * * *